US006498436B2

(12) United States Patent
Hartge et al.

(10) Patent No.: US 6,498,436 B2
(45) Date of Patent: Dec. 24, 2002

(54) METHOD FOR OPERATING A LAMP, PARTICULARLY FOR MEDICAL APPLICATIONS, AND A LAMP HAVING A DISCHARGE LAMP

(75) Inventors: Jörg Eduard Hartge, Gelnhausen; Rudolf Marka, Frankfurt; Matthias Helten, Langenselbold, all of (DE)

(73) Assignee: Heraeus Med GmbH, Hanau (DE)

( * ) Notice: Subject to any disclaimer, the term of this patent is extended or adjusted under 35 U.S.C. 154(b) by 0 days.

(21) Appl. No.: 09/728,866

(22) Filed: Dec. 1, 2000

(65) Prior Publication Data

US 2002/0011809 A1 Jan. 31, 2002

(30) Foreign Application Priority Data

Dec. 3, 1999 (DE) ..... 299 21 180
Mar. 3, 2000 (DE) ..... 100 10 139

(51) Int. Cl.[7] ..... H05B 37/00
(52) U.S. Cl. ..... 315/86; 315/88; 315/129
(58) Field of Search ..... 315/86, 87, 88, 315/129, 91; 307/64, 66; 340/333

(56) References Cited

U.S. PATENT DOCUMENTS

| | | | | |
|---|---|---|---|---|
| 4,283,657 A | * | 8/1981 | Gordon et al. | 315/86 |
| 4,799,039 A | * | 1/1989 | Balcom et al. | 320/134 |
| 5,004,953 A | * | 4/1991 | McDonald | 315/171 |
| 5,252,891 A | * | 10/1993 | Huang | 315/172 |
| 5,274,611 A | * | 12/1993 | Donohoe | 368/10 |
| 5,743,628 A | * | 4/1998 | Greif et al. | 362/228 |
| 5,828,174 A | | 10/1998 | Seiler et al. | 315/62 |
| 5,910,689 A | * | 6/1999 | Ertz et al. | 30/64 |

FOREIGN PATENT DOCUMENTS

| | | |
|---|---|---|
| DE | 33 22 943 | 2/1984 |
| DE | 38 07 585 | 9/1989 |
| DE | 40 17 839 | 12/1991 |
| DE | 94 20 348.2 | 5/1995 |
| DE | 195 05 925 | 8/1996 |
| DE | 196 10 388 | 9/1997 |
| GB | 2 215 535 | 9/1989 |

OTHER PUBLICATIONS

Article entitled "Betriebsgeräte und Schaltungen für elektrische Lampen" by Sturm, et al., Siemens Aktiengesellschaft dated 1992, 3 pages.

* cited by examiner

*Primary Examiner*—Haissa Philogene
*Assistant Examiner*—Ephrem Alemu
(74) *Attorney, Agent, or Firm*—Cohen, Pontani, Lieberman & Pavane

(57) ABSTRACT

In order to make continuous lamp operation in a failsafe lamp, particularly a lamp for medical applications, having a discharge lamp possible even When changing over between a power supply system (low voltage supply system of, for example, 24 V) and an additional safety power supply (ZSV), a buffer store is discharged in the event of a fault in the power supply for a supply unit for the lamp by changing over to a standby power source, or, once the fault has been elitinated, from the standby power source back to the normal power supply, the buffer store outputting electrical energy to operate the discharge lamp. The electrical energy supplied to the supply unit (EVG) first passes through a full-wave rectifier and is then supplied to a voltage converter containig the buffer store. The discharge lamp is subsequently supplied with the electrical energy via a power-regulated inverter. Thus, it is ensured that, even for changeover procedures with different current types—e.g. from alternating current to direct current—the power regulation of the discharge lamp permits unimpaired, continuous discharge lamp operation. In the event of a fault in the operation of the discharge lamp or its energy supply, a circuit for operating a halogen incandescent lamp as a reserve lamp is completed.

15 Claims, 2 Drawing Sheets

METHOD FOR OPERATING A LAMP, PARTICULARLY FOR MEDICAL APPLICATIONS, AND A LAMP HAVING A DISCHARGE LAMP

BACKGROUND OF THE INVENTION

1. Field of the Invention the invention relates to a method for operating a lamp, particularly a lamp for medical applications, having at least one discharge lamp which is connected to a supply unit (EVG) which receives electrical energy from a power supply system having an additional safety power supply (ZSV), the emergency power function prompting a changeover to a standby power source in the event of a fault in the power supply, and, after elimination of the fault, prompting a changeover to the power supply for normal operation. In addition, the invention relates to a failsafe lamp, particularly a lamp for medical applications.

2. Discussion of the Prior Art

A power supply system having an additional safety power supply (ZSV) is defined in VDE Regulation VDE 0107; besides the customary mains power supply, the power supply system comprises a standby power source, which is usually supported by a storage battery.

German reference DE 38 07 585 A1 discloses a surgical lamp which has a high-pressure gas discharge lamp as a light source. This lamp is connected to a supply circuit having an emergency power function, whose input can be connected to a DC voltage source having a lower voltage than the operating voltage of the discharge lamp. It comprises a plurality of first voltage converters for transforming the input voltage into the operating voltage of the discharge lamp, whose inputs are connected in parallel and whose outputs are selectively connected in parallel or in series. The multiplicity of voltage converters means that this is a relatively complex desing.

ln addition. German reference DE 195 05 925 A1 (according to U.S. Pat. No. 5,743,628) discloses a medical lamp, particularly a surgical lamp, which has at least one halogen incandescent lamp and one discharge lamp (halogen metal vapor high-pressure lamp) in its housing. In the event of a failure or fault in the static power supply provided for operating the lamp, the supply of power to the lamp is changed over to a standby power source supported by a storage battery, The radiation from the halogen incandescent lamps is available virtually without interruption on account of the thermal inertia of their coil, whereas the discharge lamp is not available for renewed ignition and startup until after a certain cooling phase over a period of several minutes.

SUMMARY OF THE INVENTION

The object of the present invention is to provide a lamp of relatively simple design in which continuous discharge lamp operation is possible even during changeover procedures or in the event of brief voltage drops or voltage failures without renewed ignition procedures. In particular, the intention is to provide a practically failsafe lamp.

Pursuant to this object, and others which will become apparent hereafter, one aspect of the present invention resides in a method in which, if a fault occurs during changeover to the standby power source, a buffer store outputs electrical energy to operate the discharge lamp.

Besides changing over in the case of pure DC voltage operation or pure AC voltage operation for the power supply system and the additional safety power supply, it is also possible to change over between different current types—e.g. from AC voltage to DC voltage or from DC voltage to AC voltage—without impairing the lamp operation, particularly the operating parameters of the discharge lamp.

The buffer store provided is advantageously an electrical capacitor which is at least partly discharged during changeover.

This means that, in the case of a fault during changeover or during a brief voltage drop, the buffer store outputs electrical energy for continuous operation of the discharge lamp.

It is found to be advantageous that, even in the event of brief interruptions, continuous lamp operation is possible without interim ignition operations for the discharge lamp. This means that no inconvenient ignition attempts are made for the discharge lamp during operation. Furthermore, the normal lighting values are quickly restored after the occurrence and elimination of faults. A further advantage can be seen in that the useful life of the lamp is improved on account of reduced loading due to fewer ignition procedures.

In one preferred embodiment of the method, the electrical energy supplied to the supply unit (EVG) first passes through a full-wave rectifier and subsequently a voltage converter containing the buffer store. Energy is subsequently supplied to the discharge lamp via a power-regulated inverter as the output stage.

It is found to be particularly advantageous that the power regulation results in a changeover both from alternating current to direct current and from direct current to alternating current having no effect on the operation of the discharge lamp.

In one preferred embodiment of the invention, while the buffer store is discharging, the discharge lamp is operated in the lower power range for stable illumination (simmer operation). Furthernore, even in the event of a failure in the region of the discharge lamp, at least a certain level of safety should be provided—e.g. in the case of medical application or in the course of a surgical procedure—by virtue of at least standby illumination being ensured by at least one halogen incandescent lamp after an operating fault in the discharge lamp circuit. In the event of a fault in the operation of the discharge lamp or its energy supply, the supply unit (EVG) is used to complete a circuit for operating at least one halogen incandescent lamp. In this context, it is found to be advantageous that an automatic changeover occurs without any significant interruption in the lamp operation.

In addition, in one preferred embodiment of the invention, the operating parameters of the lamp—such as starting procedures or illumination time of the discharge lamp—are determined using a digital computer and are possibly indicated for monitoring purposes. It is found to be advantageous that the user may actually be referred ahead of time to any relevant measures for reliable operation of the lamp.

Another aspect of the invention resides in the supply unit (EVG) having a buffer store which, in the event of a fault occurring or in the event of a fault being eliminated, is provided for outputting electrical energy for operating the discharge lamp during changeover to the standby power source or during changeover to the power supply for normal operation.

The buffer store used is advantageously an electrical capacitor, so that, in the case of a fault during changeover or during a brief voltage drop, the capacitor outputs electrical energy for continuous operation of the discharge lamp.

It is found to be advantageous that, even in the event of brief interruptions, continuous lamp operation is possible without interim ignition operations for the discharge lamp, and no inconvenient ignition attempts are made for the discharge lamp during operation.

In one preferred embodiment of the invention, a full-wave rectifier is provided at the input of the supply unit for the lamp. The output of the full-wave rectifier is connected to a power-regulated inverter via a voltage converter in order to supply the discharge lamp.

It is found to be particularly advantageous that due to the power regulation of the inverter means, changing over the current type (e.g, alternating current—direct current) does not result in any impairment of the operation of the discharge lamp.

To maximize its stored energy, the capacitor is preferably arranged in a DC voltage intermediate circuit of the supply unit. The intermediate circuit operates at an operating voltage in the range from 300 to 400 V and forms, together with a step-down converter connected downstream, a DC voltage converter which is connected via the power-regulated inverter to the discharge lamp for the purpose of supplying energy thereto. In terms of its own energy supply, the DC voltage intermediate circuit is connected to the power supply system via a mains filter, a synchronous rectifier connected upstreain of the filter as a full-wave rectifier and via a safety switch. A particular advantage is found to be low-loss operation of the circuit through synchronous rectification and regulation of the power factor.

In addition, in the preferred embodiment of the lamp, an internal auxiliary power supply is provided, with any faults in the external power supply system being detected by a voltage sensor in the region of the mains filter. The voltage sensor preferably has a comparator for detecting faults. In one preferred embodiment, the auxiliary power supply is fed from the buffer store over time.

For its part, the internal auxiliary power supply is connected to the DC voltage converter (step-down converter), to the inverter (output stage) and to a control unit and a data interface. For its part, the control unit is connected to the voltage sensor, to the DC voltage converter (step-down converter), to the data interface and to a reserve lamp controller, in order to be able to change to at least one halogen incandescent lamp in the event of a fault in the operation of the discharge lamp. The halogen incandescent lamp then being connected to the power supply system, including the additional safety power supply (ZSV), and being supplied directly from there.

In one preferred embodiment of the lamp, the discharge lamp is held in a holder which forms, with an inter for the lamp, a structural unit having a universal electrical connection between the igniter and the holder without any internal detachable connecting elements for the lamp. The result of this is, advantageous, low susceptibility to faults.

It is found to be advantageous that symmetrical ignition pulses mean that these ignition pulses travel outwards to the discharge lamp largely without losses and without any electromagnetic interference radiation, despite their large amplitude. Hence, there is also good electromagnetic compatibility in respect of electronic devices in the lamp's surroundings (EMC).

Advantageously, the structural unit comprising the igniter and the lamp is in the form of a lamp handle or support bracket connected to the holder of the discharge lamp. This refinement makes it possible to achieve a largely compact, easy to maintain design for the complete lamp.

In addition, a useful life indicator is advantageously provided for the discharge lamp, covering illumination duration and the number of ignition procedures.

An operating unit for adjusting and indicating lamp functions can be connected to the data interface connected to the control unit, so that optimum information is ensured.

In a further advantageous embodiment, the lamp according to the invention is provided with an inclination switch. It is found to be advantageous that any inclination into unwanted operating positions results in the lamp immediately being switched off, preventing thermal overloading of components.

A further advantage can be seen in that the surgeon can, if necessary—e.g. in the case of a minimally invasive or endoscopic method of treatment—, switch off the lamp by means of sterile operation on the handle (which is sterile anyway) using the inclination switch, where the bright light would interfere with the surgical lamp.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
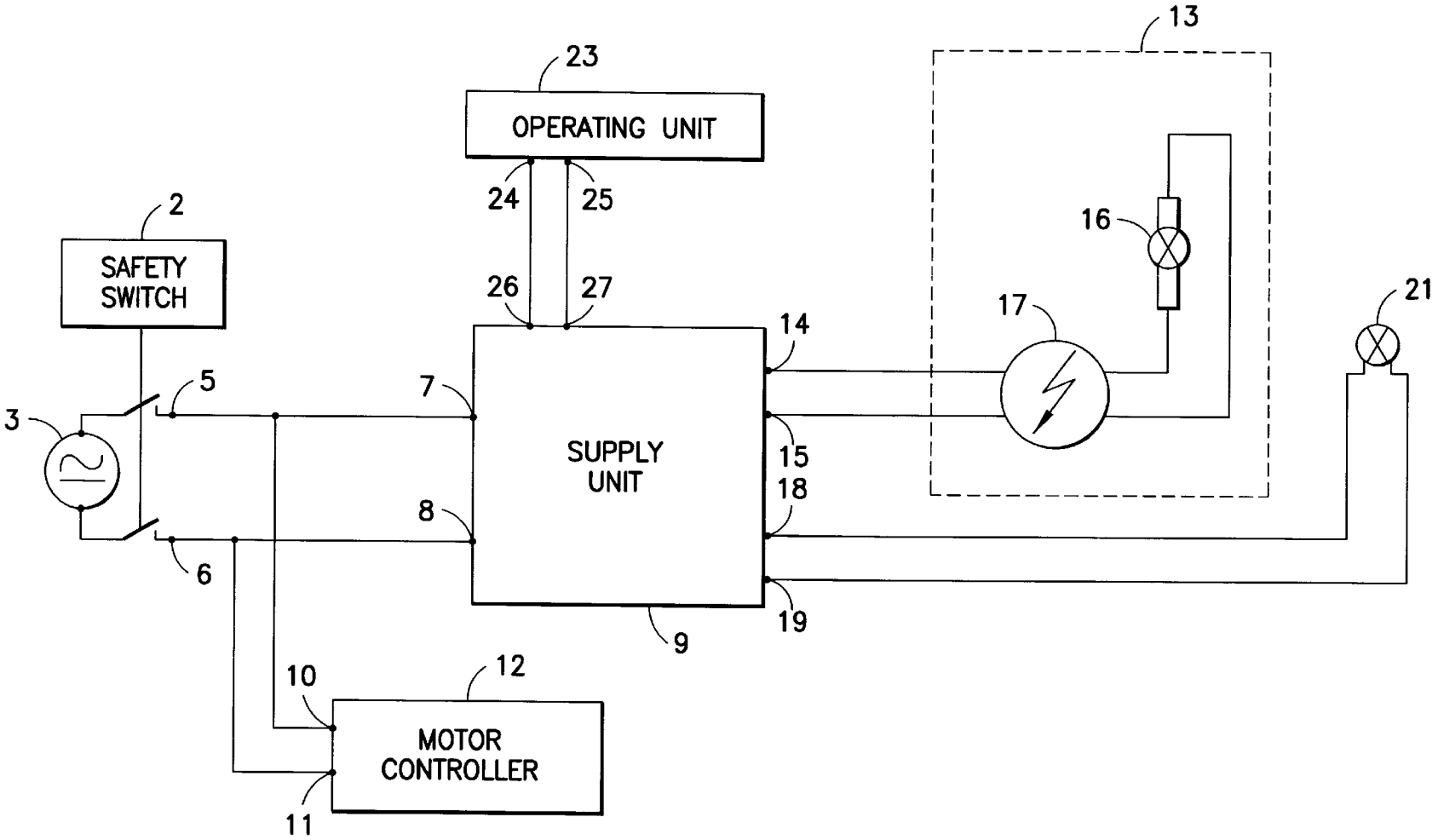
FIG. 1 shows a block diagram of the essential components of a failsafe lamp in the context of its operation.

As FIG. 1 shows, the circuit arrangement for the failsafe lamp is connected via a safety switch 2 to a symbolically illustrated power supply system 3 (low voltage mains) for a voltage of approximately 24 V. The power supply system 3 in practice is in the form of a DC voltage mains or AC voltage mains (frequency: approximately 50 Hz) having an additional safety power supply (ZSV) in line with the definition explained in the introduction This means that, in the event of a failure or fault in a static public supply network required for normal operation of the power supply system, or in a vehicle's on-board power supply, the power supply system is supplied with electrical energy from dedicated energy sources, such as storage batteries or emergency power units (ZSV).

The output side of the safety switch 2 is connected via connections 5, 6 to inputs 7, 8 of a supply unit 9 and, in parallel with the supply unit 9, to inputs 10, 11 of a motor controller 12 for adjusting lamp or reflector positions of the lamp.

The supply unit 9 has a multiplicity of individual components which are explained in more detail later with reference to FIG. 2. In FIG. 1, it can be seen that the supply unit 9 is connected via output connections 14, 15 to the discharge lamp unit 13, which has both a discharge lamp 16 and an associated igniter 17. The igniter 17 is arranged in the direct vicinity with a universal electrical connection—i.e. without detachable internal electrical connecting elements—to the holder of the discharge lamp 16, in order to keep the risk of failure—for example as a result of corrosion of contacts for electrical connecting elements—at a low level.

In addition, the supply unit 9 is connected via output connections 18, 19 to a reserve lamp 21 which, in the event of the discharge lamp 16 failing or in the event of a fault in the discharge lamp circuit, maintains the illumination by means of an automatic changeover procedure. Provided for the purpose of operation and monitoring is an operating unit 23 which is connected to connections 26, 27 of the supply unit 9 via lines 24, 25. When the lamp according to the invention is used as a surgical lamp, the operating unit 23 is arranged on the support system for the lamp and/or on a wall panel. The operating unit 23 has an operating switch (on/off pushbutton key) and two pushbutton keys for dimming the discharge lamp 16. The operating unit 23 additionally contains indicator elements for outputting the useful life and/or operating time of the discharge lamp 16, for indicating any operation of the reserve lamp 21 and also an indicator for the dimmed state of the discharge lamp 16.

Figure 2:
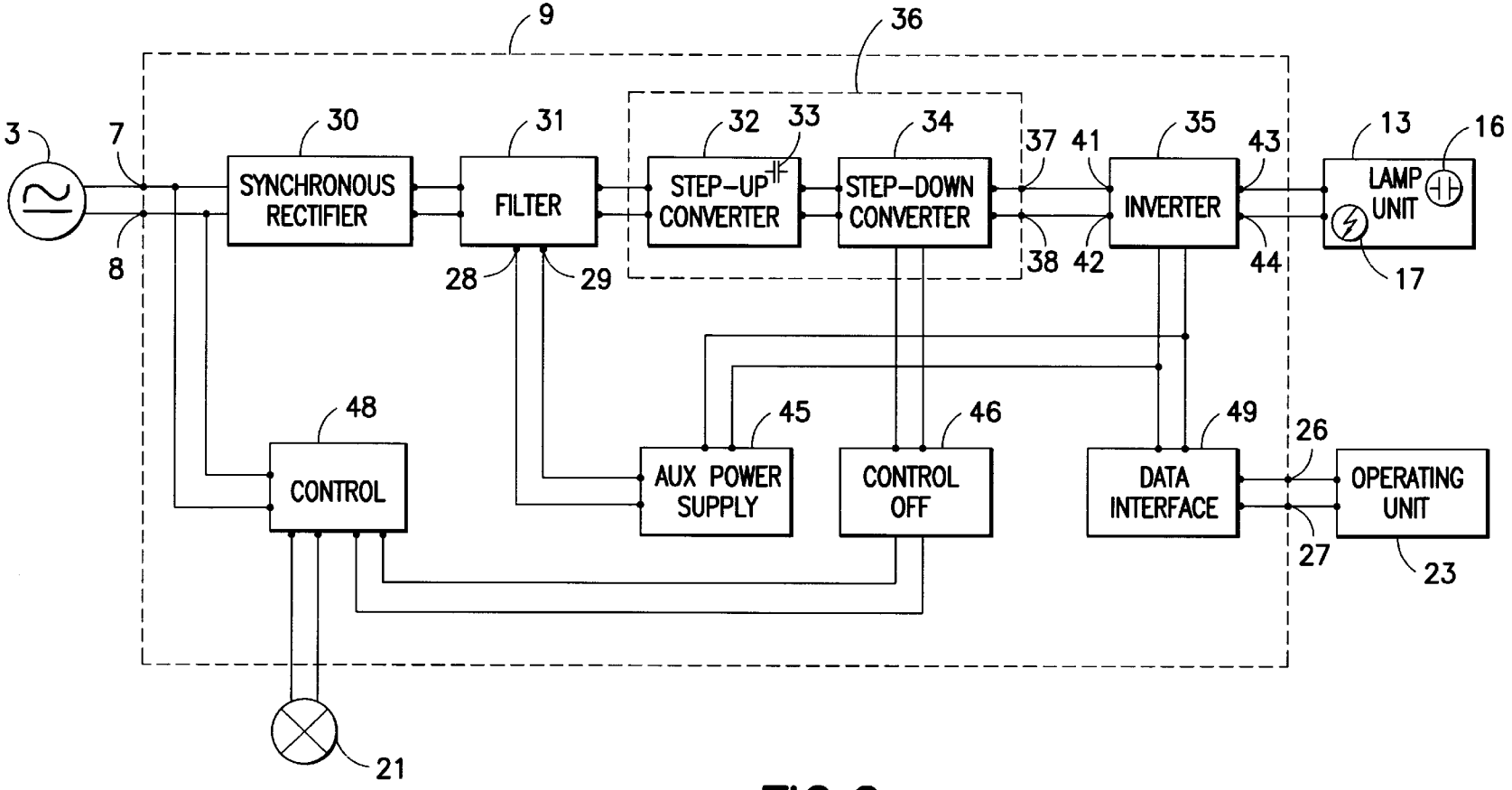
FIG. 2 shows a block diagram of the supply unit with its components and the connected peripherals.

As FIG. 2 shows, connected to the input terminals 7, 8 of the supply unit 9 is a synchronous rectifier 30 which is connected via a mains filter 31 to a DC voltage intermediate circuit having a step-up converter 32. The step-up converter 32 has a buffer capacitor 33 (illustrated symbolically in this case) which is used in the intermediate circuit for bridging brief voltage failures during lamp operation, so that there is no need for the discharge lamp 16 to fail and hence for any new ignition procedure (reignition). Connected to the DC voltage intermediate circuit (operated at a DC voltage of 300 to 400 V, preferably 360 V) with the step-up converter 32 is a converter which is described as a step-down Converter 34 and reduces the output voltage of the step-up converter 32 to a value in the range from 80 to 100 V, preferably to 90 V. The step-up converter 32 and the step-down converter 34 are used as DC voltage converters, and together form a voltage converter 36, The outputs 37, 38 of the voltage converter 36 are connected to the input 41, 42 of an output stage which is in the form of an inverter 35 and whose output 43, 44 is connected to the igniter 17, shown as a symbol, as in FIG. 1, and to the electrodes of the discharge lamp 16 which is shown symbolically in this case and is called the lamp unit 13. The output stage, which is designed as a power-regulated inverter 35, supplies the lamp unit 13 with a square-wave AC voltage whose frequency is approximately 400 Hz and whose voltage is in the range from approximately 80 to 100 V, preferably 90 V.

As FIG. 2 shows, the mains filter 31 is additionally connected to an auxiliary power supply 45 via connection 28, 29. In addition, the step-down converter 34 and the connected output stage, as the inverter 35, are also connected to the auxiliary power supply 45, which safeguards the energy supply—preferably the from buffer store 33 and via the step-down converter 34—in the event of a failure or fault in the supply voltage applied to the input terminals 7, 8. furthermore, the auxiliary power supply 45 is connected to a control unit 46 for a controller 48 of the reserve lamp 21 and for a data interface 49 for the purpose of operation or monitoring using at least one operating unit 23. The schematically illustrated connection for the signal output and input of the supply unit 9 is provided with reference numerals 26, 27 in this case. If the static supply voltage applied to the input terminals 7, 8 of the supply unit 9 drops or is disrupted, the auxiliary power supply 45 safeguards further operation of the control unit 46, the data interface 49 and the step-down converter 34, and also the reserve lamp controller 48, by discharging the buffer capacitor 33, illustrated symbolically in FIG. 2.

The control unit 46 receives a signal via a voltage sensor connected in the region of the mains filter 31, whereupon the mode for simmer operation of the discharge lamp 16 is switched on. During the actual changeover procedure in the power supply system 3, the discharge lamp unit 13 is changed over to simmer operation by means of the control unit 46 for the purpose of saving energy, with the buffer capacitor 33 being discharged via the step-down converter 34 for the purpose of bridging the time of a brief voltage failure or for the purpose of any necessary changeover to an emergency power function of the power supply system 3 (not shown in more detail here). Simmer operation of the discharge lamp unit 13 thus advantageously makes it possible to achieve an extension to the bridging time of the buffer store or buffer capacitor 33.

During emergency power operation, the power supply system 3 is supplied, for example by a ZSV (containing storage batteries or emergency power units), which is not shown here, until the static power supply network or on-board power supply of a vehicle permits normal mains operation again. During changeover of the supply mains 3 from the ZSV function to normal mains operation, the buffer capacitor 33 is again discharged to bridge the time of a brief voltage failure, since such a voltage failure arises during the changeover procedure.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention For example, it is expressly intended that all combinations of those elements and/or method steps which perform substantially the same function in substantially the same way to achieve the same results are within the scope of the intention. Substitutions of elements from one described embodiment to another are also filly intended and contemplated. It is also to be understood that the drawings are not necessarily drawn to scale but that they are merely conceptual in nature. It is the intention, therefore, to be limited only as indicated by the scope of the claims appended hereto.

We claim:

1. A method for operating a lamp having at least one discharge lamp which is connected to a supply unit which receives electrical energy from a power supply system having an additional safety power supply comprising a standby power source, the method comprising the steps of: effecting a changeover to the standby power source in response to a fault in a main power supply; effecting a changeover to the power supply unit for normal operation the fault has been eliminated, wherein, during the changeover, outputting electrical energy from a buffer store to operate the discharge lamp, the buffer store being an electrical capacitor which is at least partly discharged during the changeover; and operating the discharge lamp in a lower power range during the changeover for stable illumination.

2. The method as defined in claim 1, including using the supply unit to complete a circuit for operating at least one halogen incandescent lamp in the event of a fault in operation of the discharge lamp.

3. The method as defined in claim 1, including processing the electrical energy supplied to the supply unit first through a full-wave rectifier and then to a voltage converter, and subsequently supplying the discharge lamp with the energy via a power-regulated inverter.

4. The method as defined in claim 1, including monitoring operating parameters of the lamp with a digital computer and outputting as a signal any switching procedures carried out.

5. The method as defined in claim 4, wherein the monitoring step includes ascertaining operating time of the discharge lamp and including the operating time in an indication.

6. A lamp operating system, comprising: at least one discharge lamp; a power supply system having a power supply for normal operation and a standby power source operatively connected so that the power supply system has an additional safety power supply by changing over to the standby power source when a fault occurs, a changeover to the power supply for normal operation being effected once the fault is eliminated; and a supply unit connected between the discharge lamp and the power supply system, the supply unit having a buffer store operative to output electrical energy to operate the discharge lamp during changeover, the buffer store being an electrical capacitor, the supply unit including a full-wave rectifier provided at an input of the supply unit, a power-regulated inverter, a voltage converter arranged to connect an output of the full-wave rectifier to the power-regulated inverter as an output stage in order to supply the discharge lamp, the voltage converter including a DC voltage intermediate circuit containing a step-up converter, the buffer capacitor being arranged in the DC voltage intermediate circuit, the supply unit including a DC voltage converter arranged to connect the DC voltage intermediate circuit containing the step-up converter to the discharge lamp via the inverter and an igniter.

7. The system as defined in claim 6, wherein the DC voltage converter is a step-down converter.

8. The system as defined in claim 6, and further comprising a useful life indicator for the discharge lamp which is operatively provided so as to indicate illumination duration and number of ignition procedures.

9. The system as defined in claim 6, and further comprising an inclination switch for interrupting lamp operation.

10. The system as defined in claim 6, and further comprising an igniter for the discharge lamp, and a holder for the lamp which forms, with the igniter and the lamp, a cohesive discharge lamp unit.

11. The system as defined in claim 10, wherein a universal electrical connection between the igniter and the holder for the lamp is provided in the discharge lamp unit without any internal detachable electrical connecting elements.

12. The system as defined in claim 6, wherein the supply unit includes a mains filter arranged to connect the DC voltage intermediate circuit containing the step-up converter to the full-wave rectifier, and further comprising a safety switch connected between the power supply system and the DC voltage intermediate circuit.

13. The system as defined in claim 12, wherein the supply unit further includes an internal auxiliary power supply, a control unit and a data interface, the mains filter having an output connected to an input of the internal auxiliary power supply, the auxiliary power supply being connected to the step-down converter, the inverter, the control unit and the data interface.

14. The system as defined in claim 13, and further comprising at least one operating unit operatively connected to the data interface for setting and indicating lamp functions.

15. The system as defined in claims 13, wherein the supply unit further includes a reserve lamp controller operative to operate an incandescent lamp which is supplied by the power supply system, including the additional safety power supply, the control unit being connected to the step-down converter, the data interface and also to the reserve lamp controller.

* * * * *